US006614164B1

(12) United States Patent
Okamoto et al.

(10) Patent No.: US 6,614,164 B1
(45) Date of Patent: Sep. 2, 2003

(54) CRT WITH NECK AND STEM WELD AND METHOD FOR MANUFACTURING THE SAME

(75) Inventors: Hisakazu Okamoto, Kumagaya (JP); Shigeru Sugawara, Kodama-gun (JP); Fumitaka Hoshino, Sawa-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 573 days.

(21) Appl. No.: 09/594,554

(22) Filed: Jun. 15, 2000

(30) Foreign Application Priority Data

Jun. 16, 1999 (JP) ..... 11-169217
Jun. 7, 2000 (JP) ..... 2000-170145

(51) Int. Cl.[7] ..... H01J 9/26; H01J 5/24; H01J 9/34

(52) U.S. Cl. ..... 313/477 R; 313/318.05; 445/4.3; 445/45; 220/2.1 A; 65/34; 65/155

(58) Field of Search ..... 313/477 R, 477 HC, 313/318.05, 318.06, 318.01; 445/45, 43; 220/2.3 A, 2.1 A; 439/602, 618; 65/34, 32.2, 138, 155

(56) References Cited

U.S. PATENT DOCUMENTS 4,526,601 A * 7/1985 Igarashi et al. ..... 313/477 R
4,608,516 A * 8/1986 Oki ..... 313/477 R
4,781,639 A * 11/1988 Misono ..... 445/43
6,139,388 A * 10/2000 Mok et al. ..... 445/45
6,222,311 B1 * 4/2001 Nose et al. ..... 313/477 HC

FOREIGN PATENT DOCUMENTS

JP 57-55029 * 4/1982 ..... H01J/5/46
JP 58-032327 2/1983

* cited by examiner

*Primary Examiner*—Michael H. Day
(74) *Attorney, Agent, or Firm*—Oblon, Spivak, McClelland, Maier & Neustadt, P.C.

(57) ABSTRACT

A cathode-ray tube includes a glass envelope having a panel with an inner surface formed with a phosphor screen, and a cylindrical neck extending substantially coaxially with a tube axis. An electron gun is arranged in the neck, and a stem is welded to an end of the neck. The stem has a substantially circular disk-like flare made of glass and having an outer peripheral portion welded to the end of the neck, and a plurality of stem pins attached to the flare. The end of the neck and the flare of the stem are welded to each other such that a glass portion of the flare surrounds a glass portion of the end of the neck from outside.

9 Claims, 3 Drawing Sheets

CRT WITH NECK AND STEM WELD AND METHOD FOR MANUFACTURING THE SAME

CROSS-REFERENCE TO RELATED APPLICATIONS

This application is based upon and claims the benefit of priority from the prior Japanese Patent Applications No. 11-169217, filed Jun. 16, 1999; and No. 2000-170145, filed Jun. 7, 2000, the entire contents of which are incorporated herein by reference.

BACKGROUND OF THE INVENTION

The present invention relates to a cathode-ray tube such as a color picture tube and, more particularly, to a cathode-ray tube in which a stem is welded to the end of a neck, and relates to a method of manufacturing the same.

Generally, a color cathode-ray tube has an envelope which is constituted by a glass panel having an inner surface formed with a phosphor screen, a glass funnel bonded to the panel, and a cylindrical glass neck continuously connected to the smaller end of the funnel. To the end of the neck is welded the outer peripheral portion of a flare of the stem. An electron gun is arranged in the neck. The electron gun has three cathodes lined up in line, heaters for heating the cathodes, and a plurality of electrodes sequentially adjoining the cathodes.

In the color cathode-ray tube, three electron beams emitted from the electron gun and traveling in one flat plane in line are deflected by a deflection yoke mounted on the outer surface of the funnel to scan the phosphor screen horizontally and vertically through a shadow mask, thereby displaying a color image.

Usually, the stem is comprised of a circular plate-like glass flare, an exhaust pipe extending vertically from the center of the flare outside the neck end, a plurality of stem pins extending through the flare hermetically and lined up on a circle coaxial with the center of the flare, and fillets surrounding those inner leads of the stem pins extending in the neck, which are on the flare side. The plurality of stem pins support the cathode side of the electron gun to guide a voltage applied to the heater, cathodes, and plurality of electrodes.

In an ordinary stem, of the stem pins, outer leads extending outside the neck and inner leads extending in the neck are located on a common circle. The diameter of a pin circle defined by the plurality of stem pins is determined by the outer diameter of the neck. For example, when the outer diameter of the neck is 29.1 mm, the diameter of the pin circle is 15.24 mm.

As another stem, one disclosed in Jpn. Pat. Appln. KOKAI Publication No. 58-32327 is known. In this stem, a pin circle defined by the inner leads of a plurality of stem pins is made smaller than a pin circle defined by the outer leads, and the inner and outer leads are connected to each other through Dumet wires sealed in a flare. With this arrangement, the pin circle defined by the outer leads is kept identical with that of a stem in which the outer and inner leads are located on the common circle, so that this stem can be welded to a small-diameter neck.

As an electron gun sealing method, a cullet method and a butt seal method are known.

According to the cullet method, an electron gun supported by a stem through stem pins is inserted to a predetermined position in a neck. In this process, the whole stem is inserted in the neck, and the circumference of the flare is set to oppose the inner circumferential surface of the neck. The outer peripheral portion of the flare and the opposing neck portion are welded by heating with the flame of a gas burner. Furthermore, the extra neck portion located closer to the exhaust pipe of the stem than the welded portion is sealed by burning it off with the flame of the gas burner. This method is not suitable for a small-diameter neck, since the stem must be inserted in the neck.

According to the butt seal method, a neck is cut to a predetermined size in advance. An electron gun supported by a stem through stem pins is inserted in the neck, and the end of the neck and the flare of the stem are abutted against each other or opposed to each other at a short distance. In this state, the neck end and the flare are welded by heating with the flame of a gas burner.

With the butt seal method, the stem is not inserted in the neck, so that the neck diameter can be decreased. Since the neck diameter is decreased, a deflection coil can be arranged close to electron beams, and the deflection power can be decreased. As described in Jpn. Pat. Appln. KOKAI Publication No. 58-32327, the exhaust pipe can be made thick to improve the exhaust efficiency.

As described above, the electron gun of the cathode-ray tube is arranged in the neck with its cathode side being supported by the stem, and is sealed in the neck as the neck and stem are welded to each other. This sealing structure of the electron gun is, however, sensitive to a heat shock.

Generally, the neck of a cathode-ray tube is made of glass containing 30% to 34% of PbO, which has a high electrical resistance and breakdown voltage, and having a thermal expansion coefficient $\alpha(N)$ given by $$\alpha(N)=95 \text{ to } 96.5\times10^{-7}/°\text{C. } (0° \text{ C. to } 300° \text{ C.})$$

to match a thermal expansion coefficient $\alpha(F)=98$ to $98.5\times10^{-7}/°$C. (0° C. to 300° C.) of a funnel to which the neck is to be continuously connected.

The flare of the stem is made of glass having a thermal expansion coefficient $\alpha(S)$ given by $$\alpha(S)=91.5\times10^{-7}/°\text{C. } (0° \text{ C. to } 300° \text{ C.})$$

to match a thermal expansion coefficient $\alpha(DU)=$ approximately $90\times10^{-7}/°$C. (30° C. to 400° C.) of the Dumet wire.

Therefore, when the neck and stem are welded to each other by the butt seal method, the glass of the neck and the glass of the flare form a boundary in the lateral direction perpendicularly intersecting the tube axis (Z axis) of the envelope. When heat is applied to the welded portion, the neck expands more than the flare of the stem because of the difference between the thermal expansion coefficient $\alpha(N)$ of the neck and the thermal expansion coefficient $\alpha(S)$ of the flare of the stem, that is, $$\alpha(N)-\alpha(S)=3.5 \text{ to } 5.0\times10^{-7}/°\text{C. } (0° \text{ C. to } 300° \text{ C.})$$

so cracking occurs at the boundary.

The heat shock applied to the welded portion of the neck and stem is produced by heat radiated from a heater that heats cathodes while the cathode-ray tube is operated. In a color cathode-ray tube in which a high voltage of about 20 kV to 30 kV is applied to some electrodes of the electron gun, when cracking occurs in the welded portion to decrease the vacuum degree in the envelope, electric discharge occurs in the tube to make the cathode-ray tube defective.

In order to prevent cracking in the welded portion as described above, after the neck and stem are welded to each other, the welded portion must be annealed, or positional displacement between the neck and stem after the electron gun is sealed must be regulated strictly. When annealing the welded portion, to sufficiently remove stress strain generated in the welded portion, a long-time process is required, leading to a decrease in production efficiency.

Since the neck and stem are welded to each other by using a gas burner, an electron gun sealing apparatus is heated to a high temperature. To regulate the positional displacement strictly, the sealing apparatus must be checked and maintained frequently.

BRIEF SUMMARY OF THE INVENTION

The present invention has been made in view of the above problems, and has as its object to provide a cathode-ray tube in which a neck and stem can be welded to each other without decreasing the production efficiency, so that the welded portion is resistant against a heat shock, and a method of manufacturing the same.

In order to achieve the above object, according to the present invention, there is provided a cathode-ray tube comprising: a glass envelope having a panel with an inner surface formed with a phosphor screen, and a cylindrical neck extending substantially coaxially with a tube axis; an electron gun arranged in the neck, for emitting an electron beam toward the phosphor screen; and a stem welded to an end of the neck. The stem has a substantially circular disk-like flare made of glass and having an outer peripheral portion welded to the end of the neck, and a plurality of stem pins attached to the flare to support the electron gun and to conduct a voltage to the electron gun. The end of the neck and the flare of the stem are welded to each other such that the glass of the flare surrounds the glass of the end of the neck from outside.

With the cathode-ray tube according to the present invention, a welded portion of the end of the neck and the flare of the stem is formed substantially annularly, and an outer peripheral edge of the welded portion is displaced from an inner peripheral edge thereof onto a panel side.

The outer and inner peripheral edges of the welded portion are preferably set at a distance from each other of not less than 1 mm along the tube axis.

According to the present invention, there is provided a method of manufacturing a cathode-ray tube comprising: a glass envelope having a panel with an inner surface formed with a phosphor screen, and a cylindrical neck extending substantially coaxially with a tube axis; an electron gun arranged in the neck to emit an electron beam toward the phosphor screen; and a stem welded to an end of the neck, the method comprising the steps of:

preparing a stem including a flare having an outer peripheral portion formed with an annular projection and a plurality of stem pins attached to the flare, making an outer diameter of an end of the neck to be smaller than an outer diameter of the projection, and arranging the end of the neck and the projection of the flare to oppose each other and welding the end of the neck and the projection of the flare by heating.

Furthermore, with the method of manufacturing the cathode-ray tube according to the present invention, an annular notch corresponding to the projection of the flare is formed in an outer peripheral portion of the end of the neck to reduce the outer diameter of the end of the neck to be smaller than the outer diameter of the projection.

With the cathode-ray tube manufacturing method according to the present invention, an inner circumferential surface of the projection of the flare is tilted in a tapering manner, and an outer circumferential surface of the end of the neck is tilted in a tapering manner toward a distal end thereof to correspond to the tilt of the inner circumferential surface of the projection, thereby reducing the outer diameter of the end of the neck to be smaller than the outer diameter of the projection.

According to the present invention, there is also provided a method of manufacturing a cathode-ray tube comprising: a glass envelope having a panel with an inner surface formed with a phosphor screen, and a cylindrical neck extending substantially coaxially with a tube axis; an electron gun disposed in the neck to emit an electron beam toward the phosphor screen; and a stem welded to an end of the neck, the method comprising the steps of preparing a stem having a substantially circular disk-like flare and a plurality of stem pins attached to the flare, arranging the stem such that an outer peripheral portion of the flare is abutted against an end face of the neck, heating the end portion of the neck and the outer peripheral portion of the flare from outside, fusing an outer peripheral edge of the end of the neck and an outer peripheral edge of the flare with each other, and thereafter pulling the stem along a tube axis by a predetermined distance in a direction to separate from the neck, thereby elongating the outer peripheral edge of the flare in a direction of the tube axis, and further heating the end portion of the neck and the outer peripheral portion of the flare from outside, thereby welding the end of the neck and an entire of the outer peripheral portion of the flare.

According to the cathode-ray tube having the above arrangement and the manufacturing method therefor, since the end of the neck and the stem are welded to each other such that the outer peripheral portion of the flare surrounds the end of the neck from outside, the stress generated in the welded portion is a compression stress, and consequently the cathode-ray tube becomes resistant against a heat shock, and cracking in the welded portion can be prevented. In addition, it suffices if annealing after welding and regulation for positional displacement between the neck and stem are performed to the same level as in the conventional case. As a result, a cathode-ray tube can be manufactured without degrading the production efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode-ray tube according to an embodiment of the present invention will be described in detail with reference to the accompanying drawings.

Figure 1:
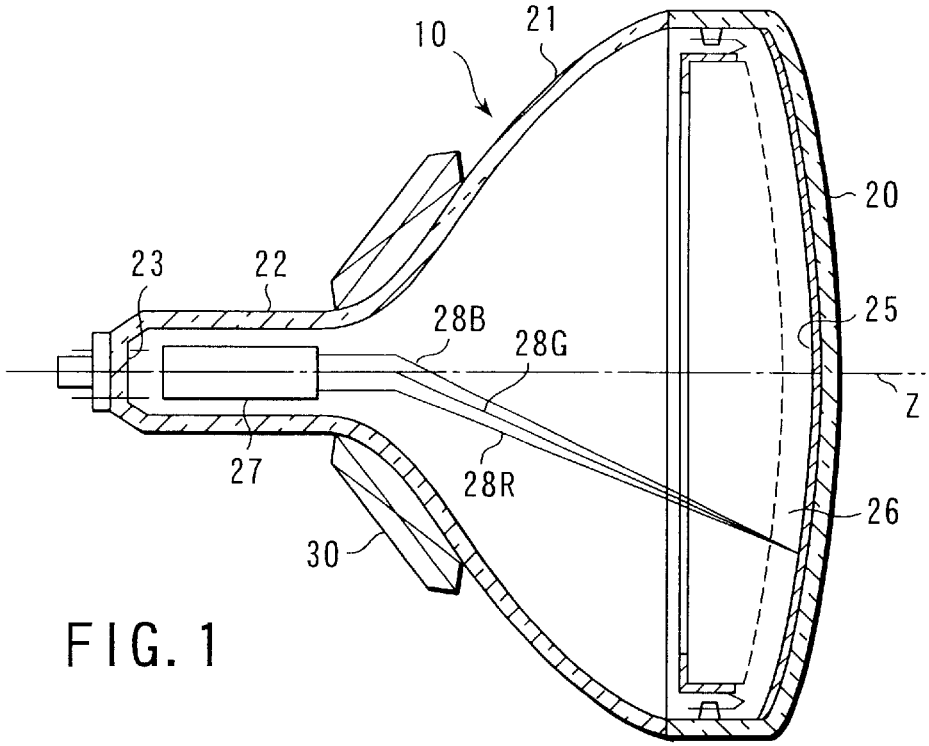
FIG. 1 is a sectional view showing a color cathode-ray tube according to an embodiment of the present invention.
Figure 2A:
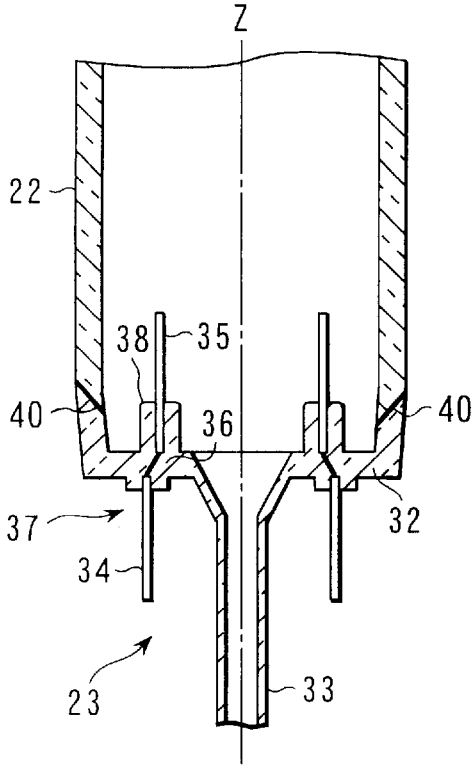
FIG. 2A is a sectional view of the end portion of the neck of the cathode-ray tube.
Figure 2B:
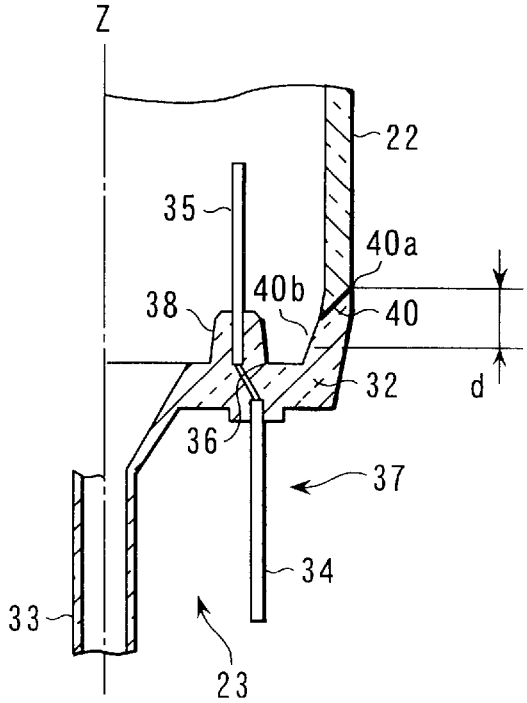
FIG. 2B is an enlarged sectional view showing part of the end portion of the neck.

As shown in FIG. 1, the color cathode-ray tube has a glass envelope 10. The envelope 10 has a substantially rectangular panel 20, a funnel 21 bonded to the panel 20, and a substantially cylindrical neck 22 continuously connected to the small-diameter end of the funnel 21. The flare of a stem 23 (to be described later) is welded to the end of the neck 22. The envelope 10 has a tube axis Z extending substantially coaxial with the neck 22 through the center of the panel 20.

A phosphor screen 25 having three color phosphor layers for emitting blue, green, and red light is formed on the inner surface of the panel 20. A shadow mask 26 is arranged in the envelope 10 to oppose the phosphor screen 25. An electron gun 27 is sealed in the neck 22. The electron gun 27 is comprised of three cathodes lined up in line, three heaters for heating the respective cathodes, and a plurality of electrodes arranged on the phosphor screen side of each cathode to sequentially adjoin thereto.

In the color cathode-ray tube, three electron beams 28B, 28G, and 28R, emitted from the electron gun 27 and passing on a common horizontal plane in line, are deflected by a deflection yoke 30 mounted to cover a range from the outer surface of the small-diameter portion of the funnel 21 to the outer surface of the neck 22, to scan the phosphor screen 25 horizontally and vertically through the shadow mask 26, thereby displaying a color image.

As shown in FIGS. 2A to 3B, the stem 23 has a circular disk-like glass flare 32, an exhaust pipe 33 extending perpendicularly from the center of the flare 32 outside the end of the neck 22, and a plurality of stem pins 37 fixed to the flare 32 to extend parallel to the tube axis Z, i.e., the central axis of the neck 22. Each stem pin 37 includes an inner lead 35 extending from the flare 32 into the neck 22, an outer lead 34 extending from the flare 32 outside the neck 22, and a Dumet wire 36 connecting the leads 35 and 34.

The inner leads 35 of the stem pins 37 line up in one circle (pin circle) 31 having the center of the flare 32 as the center. Similarly, the outer leads 34 of the stem pins 37 line up in one circle (pin circle) having the center of the flare 32 as the center. In this stem 23, the pin circle 31 defined by the inner leads 35 has a smaller diameter than that of the pin circle defined by the outer leads 34. The flare 32 is integrally formed with fillets 38 each surrounding the flare-side end of the corresponding inner lead 35.

More specifically, in the stem 23 to be welded to a neck having an outer diameter of 22.5 mm and an inner diameter of 19.0 mm, while the pin circle defined by the outer leads 34 has a diameter of 15.24 mm, the pin circle 31 defined by the inner leads 35 has a diameter of 13.3 mm. The diameter of the pin circle defined by the outer leads 34 is the same as that of the pin circle defined by the outer leads of a stem used in an inline color cathode-ray tube having a neck with an outer diameter of 29.1 mm. The number of stem pins is 14, and the distance among the adjacent inner leads is 2.96 mm.

The flare 32 of the stem 23 is welded to the end of the neck 22 at its outer peripheral portion. In this case, the outer peripheral portion of the flare 32 is welded to the end of the neck 22 to surround it from outside. A welded portion 40 of the end of the neck 22 and of the flare 32 forms an annular shape, and is tilted toward the panel 20 side from the inner peripheral edge to the outer peripheral edge. More specifically, an outer peripheral edge 40*a* of the welded portion 40 is displaced from an inner peripheral edge 40*b* onto the panel 20 side by a distance (difference) d in the direction of the tube axis Z. Note that the distance d is set to 1 mm or more.

The electron gun 27 is supported in the neck 22 as it is connected to the inner leads 35 of the stem pins 37, and a voltage is applied to the electron gun 27 through the stem pins 37.

Figure 3A:
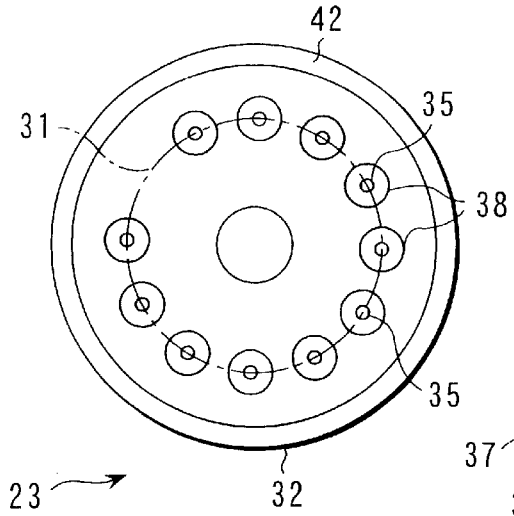
FIG. 3A is a plan view of a stem to be welded to the end of the neck.
Figure 3B:
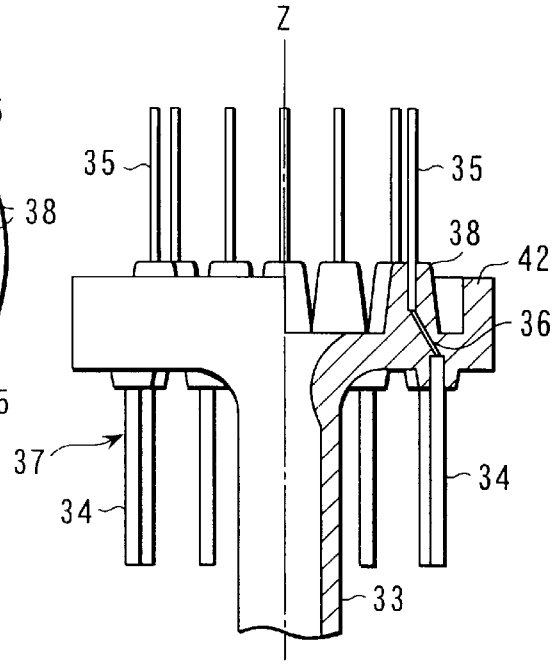
FIG. 3B is a partially sectional side view of the stem.
Figure 4:
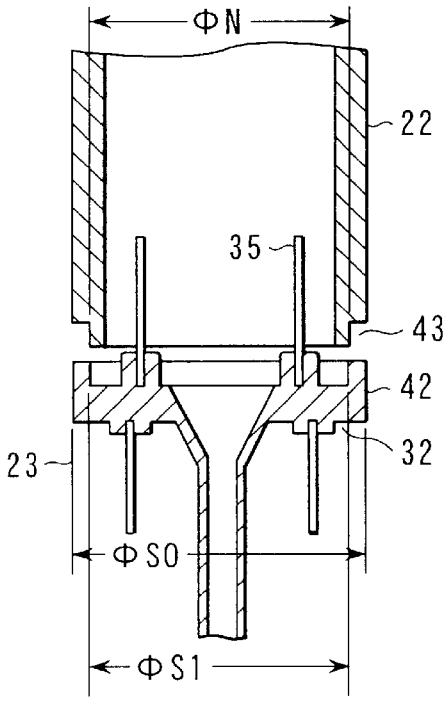
FIG. 4 is a sectional view showing a process of welding the end of the neck and the stem.

The neck 22 and flare 32 are welded to each other as described above in the following manner. As shown in FIGS. 3A and 3B and FIG. 4, before welding, the outer peripheral portion of the flare 32 of the stem 23 integrally has an annular projection 42 projecting in the same direction as the inner leads 35. The outer peripheral portion of the end of the neck 22 has an annular notch 43 for engaging with the projection 42 of the stem 23.

An outer diameter $\phi N$ of the end of the neck 22 is smaller than an outer diameter $\phi S0$ of the projection 42 of the flare 32 ($\phi N<\phi S0$), and preferably the outer diameter $\phi N$ of the end of the neck 22 is equal to or smaller than an inner diameter $\phi S1$ of the projection 42 ($\phi N \leqq \phi S1$). The end of the neck 22 and the outer peripheral portion of the flare 32 are abutted to each other, and the projection 42 and the notch 43 in the end of the neck 22 are fitted with each other or opposed to each other with a small gap. In this state, the projection 42 is externally heated by a gas burner or the like to weld the outer peripheral portion of the flare 32 and the end of the neck 22 to each other by heating. Hence, the stem 23 is welded to the end of the neck 22, the envelope 10 is sealed, and the electron gun 27 is arranged in the neck 22.

Figure 5:
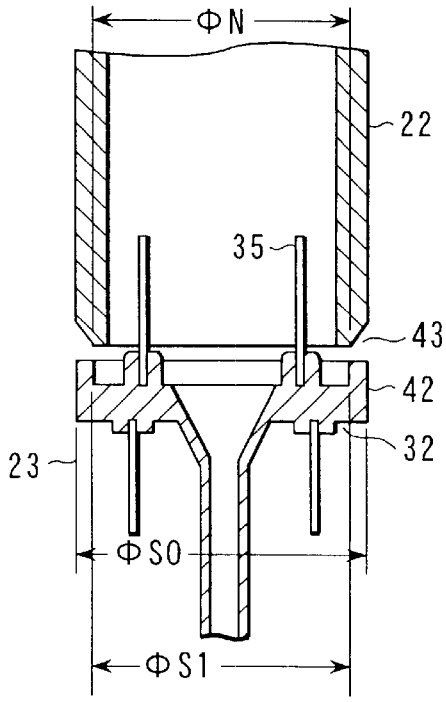
FIG. 5 is a sectional view showing another process of welding the end of the neck and the stem.

Alternatively, the neck 22 and flare 32 may be welded to each other in the following manner. As shown in FIG. 5, before welding, the outer peripheral portion of the flare 32 of the stem 23 integrally has an annular projection 42 projecting in the same direction as the inner leads 35. In this case, the inner circumferential surface of the projection 42 is tapered to tilt outwardly from the flare 32 to the panel 20.

The end of the neck 22 has a notch 43 in its outer circumferential surface, and is tapered narrower toward its distal end. An outer diameter $\phi N$ of the end of the neck 22 is smaller than an outer diameter $\phi S0$ of the projection 42 of the flare 32 ($\phi N<\phi S0$), and preferably the outer diameter $\phi N$ of the end of the neck 22 is equal to or smaller than an inner diameter $\phi S1$ of the projection 42 ($\phi N \leqq \phi S1$).

The end of the neck 22 and the outer peripheral portion of the flare 32 are abutted to each other, and the projection 42 and the notch 43 in the end of the neck 22 are engaged with each other or opposed to each other with a small gap. In this state, the projection 42 is externally heated by a gas burner or the like to weld the outer peripheral portion of the flare 32 and the end of the neck 22 to each other by heating. Hence, the stem 23 is attached to the end of the neck 22, the envelope 10 is sealed, and the electron gun 27 is arranged in the neck 22.

In the color cathode-ray tube having the above arrangement, the electron gun 27 is sealed in the neck 22 by welding the stem 23 to the end of the neck 22 such that the outer peripheral portion of the flare 32 surrounds the end of the neck 22 from outside. Then, the welded portion 40 of the neck 22 and stem 23 can be made resistant against a heat shock so as not to cause cracking. In addition, it suffices if annealing after welding and regulation for positional displacement between the neck 22 and stem 23 upon sealing the electron gun are performed to the same level as in the conventional case. As a result, a color cathode-ray tube can be manufactured without degrading the production efficiency.

More specifically, as described above, generally, a thermal expansion coefficient αN of the neck of a cathode-ray tube is set to $$\alpha(N)=95 \text{ to } 96.5\times10^{-7}/°\text{C. (0 to 300° C.)}$$

so as to match the thermal expansion coefficient of a funnel, while a thermal expansion coefficient α(S) of the flare of a stem is set to $$\alpha(S)=91.5\times10^{-7}/°\text{C. (0 to 300° C.)}$$

so as to match the thermal expansion coefficient of the Dumet wire. Therefore, a difference in thermal expansion coefficient of $$\alpha(N)-\alpha(S)=3.5 \text{ to } 5.0\times10^{-7}/°\text{C. (0 to 300° C.)}$$

is present between the neck 22 and the flare 32 of the stem 23. When the neck 22 and stem 23 are welded to each other, a stress strain occurs in the welded portion. This stress strain cannot be removed even when annealing is performed for a long period of time, and cracking occurs in the welded portion due to a heat shock.

In contrast to this, according to this embodiment, since the neck 22 and stem 23 are welded to each other such that the outer peripheral portion of the flare 32 surrounds the end of the neck 22 from outside, at least part of the stem 23 is located at a position radially outward of the end of the neck 22 with respect to the tube axis Z. Therefore, the stress generated in the welded portion 40 is a compression stress, and consequently the cathode-ray tube becomes resistant against a heat shock, and cracking in the welded portion can be prevented.

Table 1 below shows the result of a heat shock test for envelopes performed when, in the welded portion 40 of the flare 32 of the stem 23 and of the end of the neck 22, the distance d between the outer peripheral edge 40*a* and inner peripheral edge 40*b* of the welded portion 40 along the axis Z is set to 0 mm, 0.5 mm, 1.0 mm, and 1.5 mm, respectively.

TABLE 1

| Distance d (mm) | Number of occurrence of cracking | Rate of occurrence of cracking (%) |
|---|---|---|
| 0 | 8 | 40 |
| 0.5 | 2 | 10 |
| 1.0 | 0 | 0 |
| 1.5 | 0 | 0 |

The number of envelopes subjected to the test for each distance d is 20, and the distance d varies depending on the locations of the welded portion due to the manufacturing method. Therefore, the distance d is expressed as an average of those at two symmetrical positions of the welded portion.

As is seen from Table 1, when the distance (difference) d between the outer and inner peripheral edges 40*a* and 40*b* of the welded portion 40 is 0 mm, that is, in the conventional cathode-ray tube, the rate of occurrence of cracking caused by a heat shock was 40%. When the distance d was set to 0.5 mm, the rate of occurrence of cracking was reduced to 10%. When the distance d was set to 1.0 mm or more, cracking was eliminated almost completely.

From the above result, the distance d between the outer and inner peripheral edges 40*a* and 40*b* of the welded portion 40 is desirably set to 1.0 mm or more.

As another manufacturing method of a color cathode-ray tube according to the present invention, a welding method of welding a flare having no projection and a neck having no notch to each other will be described.

Figure 6B:
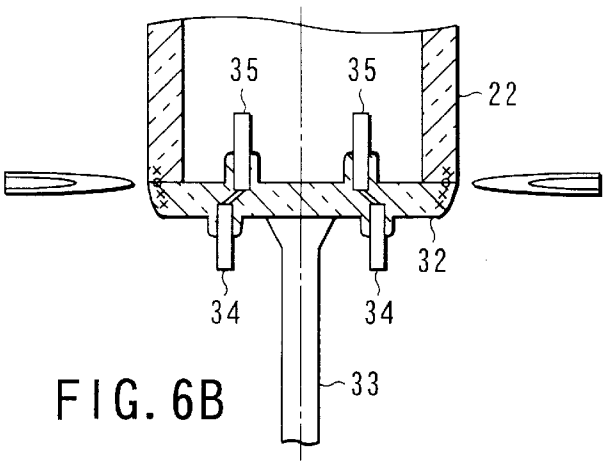
FIGS. 6A to 6D are sectional views each showing a welding process according to another embodiment of the present invention.
Figure 6A:
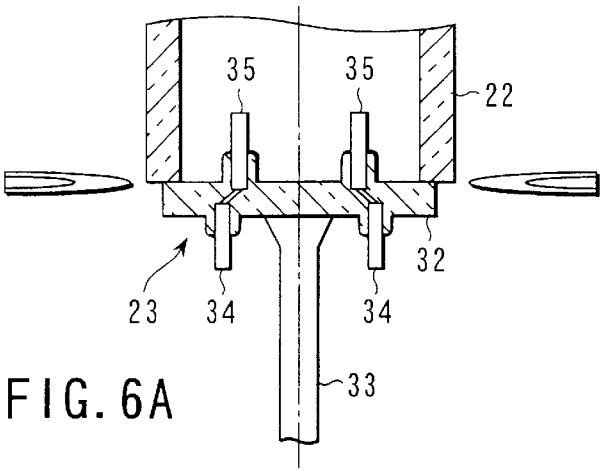

As shown in FIG. 6A, before welding, the outer peripheral portion of a flare 32 of a stem 23 is formed flat to have no projection, and the end of a neck 22 is also formed flat, in the same manner as in the prior art. First, the end of the neck 22 and the upper surface of the outer peripheral portion of the flare 32 are abutted to each other. In this state, a portion ranging from the flare 32 to the distal end of the neck 22 is externally heated by a gas burner to melt the outer circumferential portions of neck glass and stem glass, thereby fusing mainly the outer circumferential portion of the neck glass and the outer circumferential portion of the stem. This corresponds to the first half of burner heating. In FIG. 6B, molten glass portions are indicated by X and portions where neck glass and stem glass have fused are indicated by ○.

Figure 6D:
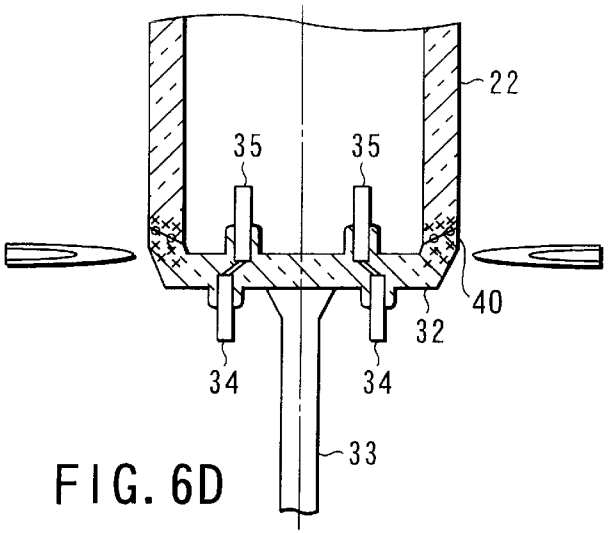
Figure 6C:
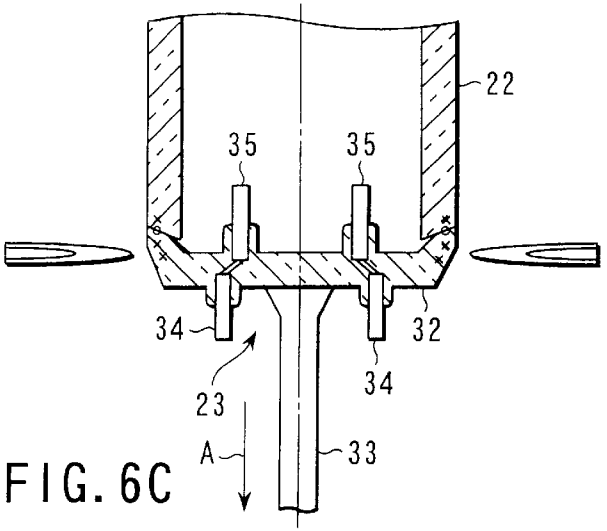

When the first half of burner heating is ended, the whole portion of the stem 23 is pulled along the tube axis Z to separate it from the neck 22, as indicated by an arrow A in FIG. 6C. Then, due to the tension of molten stem glass, a stem glass tilt surface is formed on the outer peripheral portion of the flare 32. At this stage, since the inner circumferential portions of the neck end and the flare have not melted sufficiently, the stem glass mainly only on the outer peripheral edge of the flare 32 is elongated in the direction of the tube axis Z, to form this tilt surface.

The pull amount of the stem 23 is adjusted in a range of 0.5 mm to 1.5 mm in an inline color cathode-ray tube having a neck 22 with an outer diameter of 22.5 mm to 29.1 mm.

After that, as shown in FIG. 6D, heating with the gas burner is continued to weld glass on the inner circumferential side of the neck end and stem glass to each other. As a result, a welded portion 40 of the end of the neck 22 and of the flare 32 of the stem 23 can be tilted obliquely from the outer peripheral edge toward the inner peripheral edge. Thus, the outer peripheral edge is displaced from the inner peripheral edge on the panel side.

Hence, the stem 23 is attached to the neck end, an envelope 10 is sealed, and an electron gun 27 is arranged in the neck 22.

With the above manufacturing method as well, the neck 22 and stem 23 can be welded to each other such that the outer peripheral portion of the flare 32 surrounds the end of the neck 22 from outside. Therefore, in the same manner as in the embodiment described above, a cathode-ray tube, which is resistant to a heat shock and can prevent cracking at the welded portion, can be obtained. According to this embodiment, a projection need not be formed on the stem or a notch need not be formed in the neck end, thus further improving the manufacturing efficiency.

The present invention is not limited to the embodiments described above, but various changes and modifications may be made within the scope of the invention. For example, the thermal expansion coefficient of glass used to form the neck, stem, and the like of the envelope is not limited to the values described above, but can be changed as required. Furthermore, the present invention can be applied to a cathode-ray tube other than a color cathode-ray tube while achieving the same effect.

According to the above embodiments, in the flare of the stem, the outer circumferential edge of the welded portion is closest to the panel. However, the present invention is not limited to this. In the welded portion, if that portion of the flare which is the closest to the panel is distant from that portion of the neck end, which is the closest to the stem, by 1 mm or more in the tube axis direction, and is located radially outside thereof, the same advantages as in the above-mentioned embodiments can be achieved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube comprising:

a glass envelope having a panel with an inner surface formed with a phosphor screen, and a cylindrical neck extending substantially coaxially with a tube axis;

an electron gun arranged in the neck, for emitting an electron beam toward the phosphor screen; and a stem welded to an end of the neck, the stem having a substantially circular disk-like flare made of glass and having an outer peripheral portion welded to the end of the neck, and a plurality of stem pins attached to the flare to support the electron gun and to conduct a voltage to the electron gun, and the end of the neck and the flare of the stem being welded to each other such that a glass portion of the flare surrounds a glass portion of the end of the neck from outside.

2. A cathode-ray tube according to claim 1, wherein a welded portion of the end of the neck and the flare of the stem is formed in a substantially annular, and an outer peripheral edge of the welded portion is displaced from an inner peripheral edge thereof onto a panel side.

3. A cathode-ray tube according to claim 2, wherein the outer and inner peripheral edges of the welded portion are distant from each other by less than 1 mm along the tube axis.

4. A cathode-ray tube according to claim 1, wherein in the welded portion of the end of the neck and the flare of the stem, that portion of the end of the neck which is closest to the stem and that portion of the flare which is closest to the panel are distant from each other by 1 mm or more along the tube axis.

5. A method of manufacturing a cathode-ray tube comprising: a glass envelope having a panel with an inner surface formed with a phosphor screen, and a cylindrical neck extending substantially coaxially with a tube axis; an electron gun arranged in the neck, for emitting an electron beam toward the phosphor screen; and a stem welded to an end of the neck, the method comprising the steps of:

preparing a stem including a flare having an outer peripheral portion formed with an annular projection, and a plurality of stem pins attached to the flare;

making an outer diameter of an end of the neck to be smaller than an outer diameter of the projection; and arranging the end of the neck and the projection of the flare to oppose each other and welding the end of the neck and the projection of the flare by heating.

6. A method according to claim 5, wherein the step of making an outer diameter of an end of the neck to be smaller includes forming an annular notch corresponding to the projection of the flare in an outer peripheral portion of the end of the neck.

7. A method according to claim 5, wherein the step of making an outer diameter of an end of the neck to be smaller includes tapering an inner circumferential surface of the projection of the flare, and tapering an outer circumferential surface of the end of the neck toward a distal end thereof so as to correspond to the inner circumferential surface of the projection.

8. A method of manufacturing a cathode-ray tube comprising: a glass envelope having a panel with an inner surface formed with a phosphor screen, and a cylindrical neck extending substantially coaxially with a tube axis; an electron gun arranged in the neck, for emitting an electron beam toward the phosphor screen; and a stem welded to an end of the neck, the method comprising the steps of:

preparing a stem having a substantially circular disk-like flare and a plurality of stem pins attached to the flare;

arranging the stem such that an outer peripheral portion of the flare is abutted against an end face of the neck;

heating an end of the neck and the outer peripheral portion of the flare from outside;

fusing an outer peripheral edge portion of the end of the neck and an outer peripheral edge portion of the flare with each other, and thereafter pulling the stem along the tube axis by a predetermined distance in a direction to separate from the neck, thereby elongating the outer peripheral edge portion of the flare in a direction of the tube axis; and further heating the end of the neck and the outer peripheral portion of the flare from outside, thereby welding the end of the neck and the outer peripheral portion of the flare.

9. A method according to claim 8, wherein the step of pulling the stem comprises pulling the stem by approximately 0.5 mm to 1.5 mm.

* * * * *